US006448494B1

(12) United States Patent
Erlich et al.

(10) Patent No.: US 6,448,494 B1
(45) Date of Patent: Sep. 10, 2002

(54) CABLE UNCOILING DEVICE FOR ROBOTIC POOL CLEANER

(75) Inventors: Gloria Erlich, North Caldwell; Seth M. Chilton, Caldwell, both of NJ (US)

(73) Assignee: Aqua Products, Inc., Cedar Grove, NJ (US)

( * ) Notice: Subject to any disclaimer, the term of this patent is extended or adjusted under 35 U.S.C. 154(b) by 0 days.

(21) Appl. No.: 09/707,763

(22) Filed: Nov. 7, 2000

(51) Int. Cl.[7] ..... B25G 1/00

(52) U.S. Cl. ..... 174/46; 174/10; 174/13; 174/73.1; 174/135

(58) Field of Search ..... 174/10, 13, 46, 174/69, 73.1, 135; 15/143.1, 350, 351, 410

(56) References Cited

U.S. PATENT DOCUMENTS 4,989,295 A * 2/1991 Guhne et al. ..... 15/410
5,337,434 A * 8/1994 Erlich ..... 15/1.7
5,867,862 A * 2/1999 Ahlif et al. ..... 15/329
5,911,381 A * 6/1999 Wacinski et al. ..... 242/361.4
5,973,264 A * 10/1999 O'Connor ..... 174/69
6,096,976 A * 8/2000 Nagaoka et al. ..... 174/69
6,310,290 B1 * 10/2001 Gretz ..... 174/65 R

* cited by examiner

*Primary Examiner*—Chau N. Nguyen
*Assistant Examiner*—Adolfo Nino
(74) *Attorney, Agent, or Firm*—Abelman, Frayne & Schwab

(57) ABSTRACT

An apparatus and method is provided for removing undesired coiling or twisting that has developed in a power cable attached to a robotic swimming pool cleaner during the cleaner's pre-programmed or random movement over the bottom and/or side walls of the pool. A rotatable grip assembly is permanently or removably affixed to the power cable adjacent one or both ends of the power cable that can be disconnected from the power supply or the pool cleaner. The rotatable grip assembly includes one or more bearings, at least a portion of which bearings is fixed with respect to the power cable, and a gripping member that is in contact with the one or more bearings. When the coils or twists are to be removed, the end of the power cable to which the grip assembly is attached is disconnected and a longitudinal or axial force is applied to the gripping member in the direction of the free end, which force is translated by the bearings to a rotational movement of the power cable that passes axially through the annular grip assembly. The axial force is maintained until the rotation of the power cable ceases.

24 Claims, 4 Drawing Sheets

CABLE UNCOILING DEVICE FOR ROBOTIC POOL CLEANER

FIELD OF THE INVENTION

The invention relates to an electrically-powered submersible robotic pool cleaner that is connected to a remote power supply by a floating power cable.

BACKGROUND OF THE INVENTION

Self-propelled robotic pool cleaners are designed to traverse either a pre-programmed pattern or a random path across the bottom of the pool for the purpose of cleaning the bottom, and in some case, also the side walls of the pool. The submerged cleaner receives its power through a buoyant power cable attached to a fixed or portable power supply located in the proximity of the pool. When the cleaner is not in use, the power cable is typically gathered in the form of a loose coil for storage. The power cable is either manufactured to exhibit a tendency to form the coil, or will exhibit such a tendency after a period of use. However, the coils are easily displaced when the cable is stretched out upon the surface of the pool and attached to the power supply.

During operation of the pool cleaner, the repetitive turning motion of the cleaner back and forth from one side wall of the pool to the other and from end to end has a tendency to form coils in the floating power cable. If the size and configuration of the pool is known, it is possible to pre-program the operation of the pool cleaner to periodically reverse the pattern of movement in order to remove the coils that were formed in a prior programmed pattern of movement. However, this option is not always provided even in programmable pool cleaners, and is simply not possible in pool cleaners that are designed to move in a random path. As the coils are formed in the power cable, they have the effect of reducing the ability of the cable to extend its full length as is required to follow the path of the submerged moving cleaner. If the coiling continues, the intended movement of the cleaner along a prescribed path is interrupted, with the result that the cleaner cannot complete its cleaning cycle. In some cases, the cleaner is displaced from the bottom or side wall of the pool and becomes disabled or damaged by not being properly oriented. For example, if the pool cleaner is caused to float upside down to the surface of the pool, its intake system may no longer be able to draw water in necessary to cool the one or more motors that power the pumps and/or the mechanical drive mechanism, thereby resulting in damage to the motor and necessitating expensive repairs.

The problems associated with the coiling of the power cable are well known, and one solution to the problem has been to provide an electrical connector on the body or housing of the pool cleaner which permits that end of the power cable to rotate in response to the tension or forces transmitted by the power cable when the pool cleaner changes direction. As would be expected, these highly specialized electrical connectors constitute a substantial additional expense to the manufacturer, which is passed along in a higher cost of the finished cleaner to the ultimate purchaser. Especial care must be taken during the handling and storage of the pool cleaner to avoid damaging these swivel connectors. These swivelling connectors are also subject to much greater wear and tear than a fixed power cable connector and thereby result in additional expenses to the pool cleaner owner for eventual repair and/or replacement.

An other solution to the problem of cable coiling has simply been to disconnect the remote end of the cable from the power supply and to manually untwist the coils. As would be expected, this is a tedious and time-consuming task of manual labor which is particularly difficult to complete when the pool cleaner and cable are left in the water. The work of uncoiling the cable is reduced somewhat if the pool cleaner and attached cable are removed to the side of the pool. The task may be analogized to removing the coils from a garden hose which generally requires not only a twisting but a lifting of the hose from the ground in order to reduce the friction encountered.

It is therefore an object of the present invention to provide an efficient and easy to use apparatus and method for removing the undesired coils in a pool cleaner power cable that are formed during use.

Another object of the invention is provide such an apparatus that is relatively simple and inexpensive to manufacture and install on the cable, that requires no special care in use and in handling, and that is not easily damaged.

A further object of the invention is to provide an apparatus that can be installed on the power cable during assembly of the electrical connectors on the cable, or fitted to power cables that are already in use with swimming pool cleaners.

SUMMARY OF THE INVENTION

The above objects and other advantages are realized from the invention which broadly comprehends a grip assembly that is axially-mounted for rotation on the power cable at a position that is proximate an end of the power cable that can be disconnected from either the pool cleaner, or preferably, the power supply. The rotatable grip assembly includes one or more bearing means, the position of at least one portion of each of the bearing means being fixed with respect to the power cable. The grip assembly also includes a manual gripping member that contacts or can be brought into contact with the bearing means. In a preferred embodiment, the grip assembly is permanently mounted on the power cable; however, the grip assembly can also be produced in the form of a hinged or a longitudinally divided device that is releasably clamped onto the power cable for use and then removed.

At such time as undesired coils or twisting has occurred during use of the pool cleaner, the end of the power cable to which the grip assembly is attached is disconnected from the power supply or pool cleaner. A longitudinal or axial force is applied to the grip member in the direction of the free end of the cable. This axial force, or pulling on the free end, is translated by the bearing means into rotational movement of the power cable in the direction that will release the undesired coils and twisting of the power cable. The application of the axial force on the cable is discontinued when the cable ceases to rotate.

The method of the invention broadly comprehends:

(1) axially mounting a grip member for rotational movement on the power cable adjacent a first end of the cable that can be disconnected from either the power supply or the pool cleaner;

(2) disconnecting the power cable that has become twisted and coiled during its operation;

(3) manually applying an axial force to the exterior surface of the grip member in the direction of the free end of the cable against the resistive force of the coiled power cable, thereby causing the power cable to rotate with respect to the grip; and (4) continuing to manually apply the axial force to the grip member until the relative rotation of the power cable ceases.

BRIEF DESCRIPTION OF THE DRAWINGS

The invention will be further described with reference to the attached drawings in which like elements bear the same reference numeral and where.

DETAILED DESCRIPTION OF PREFERRED EMBODIMENTS

Figure 1:
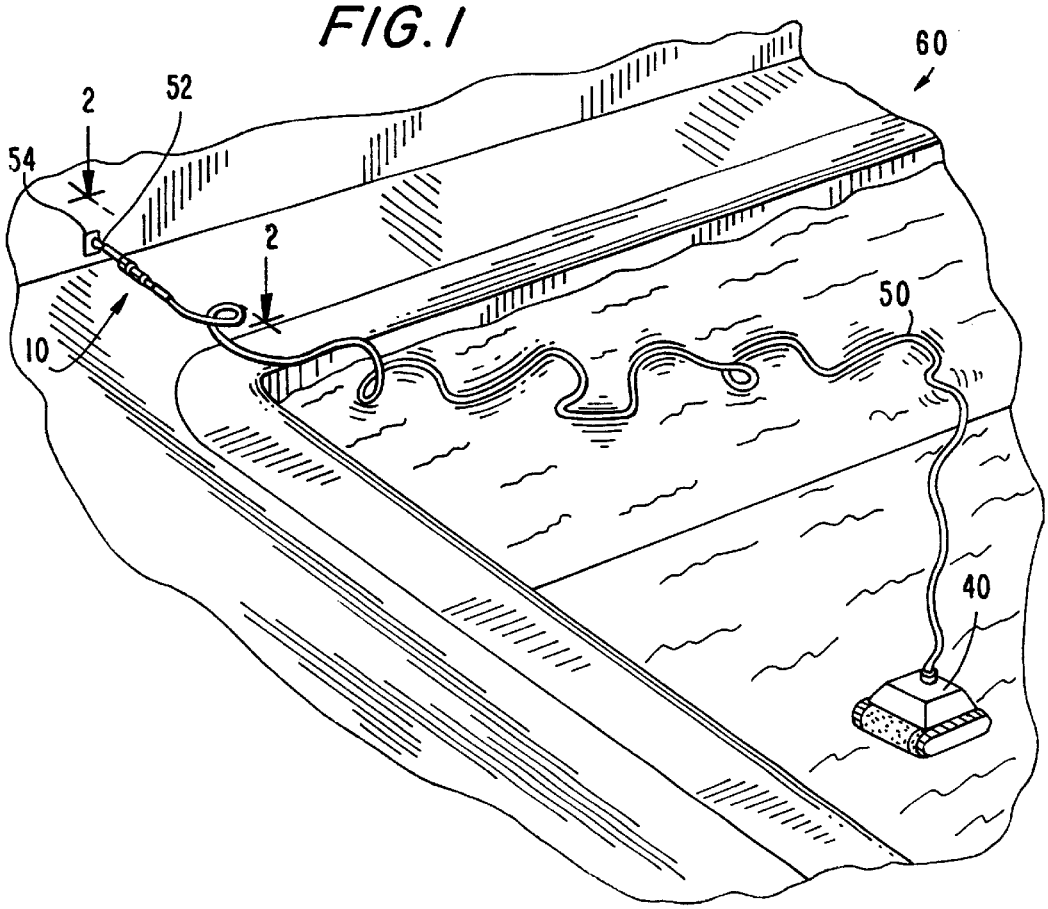
FIG. 1 is a top perspective view of a portion of a swimming pool showing an operating pool cleaner having a power cable fitted with one embodiment of the invention.

With reference to FIG. 1, there is shown a self-propelled robotic swimming pool cleaner 40 traversing the bottom surface of swimming pool 60. Due to the repetitive turning movements of the cleaner 40, the attached power cable 50 has become coiled and twisted so that its effective length between the cleaner and the fixed external power supply 54 located adjacent the pool has been shortened. As illustrated in FIG. 1, but as more clearly shown in FIG. 2, the uncoiling apparatus 10 of the invention is affixed to the power cable 50 proximate the plug or cable connector by which the power cable is joined to the outlet of the power supply 54. In alternative embodiment, the uncoiling apparatus can be affixed to the opposite end of the power cable 50 proximate a removable electrical connector (not shown) that allows the cable to be disconnected from the swimming pool cleaner 40. In yet another embodiment, where both ends of the power cable 50 can be removed from attachment to the power supply and the pool cleaner, the uncoiling apparatus can be affixed adjacent to both of the free ends to further facilitate and expedite the removal of coils and untwisting of the power cable. It will also be understood that one or more uncoiling assemblies 10 can be affixed at positions intermediate the ends of very long cables to facilitate the removal of twists and coils in intermediate sections, thereby reducing the forces that would have to be applied over the entire length of the power cable 50.

Figure 2:
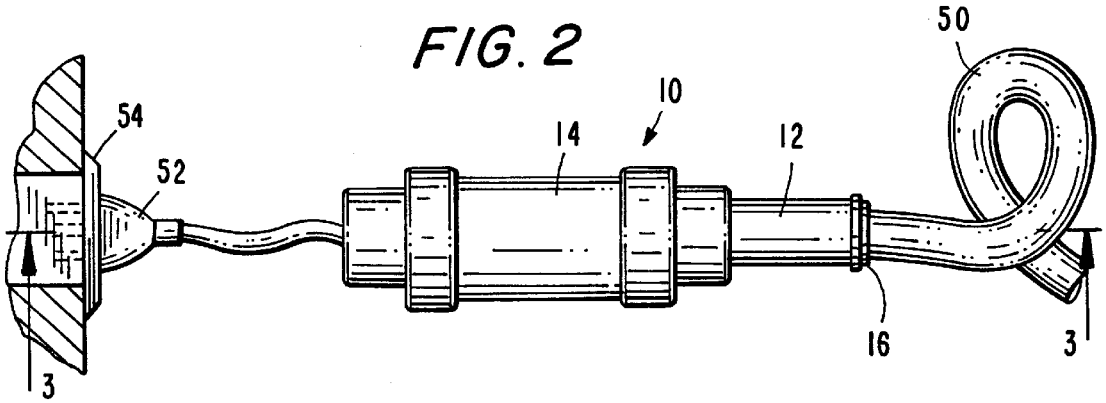
FIG. 2 is a side elevation view, partial in section, illustrating one embodiment of the apparatus of the invention in relation to a coiled power cable.
Figure 3:
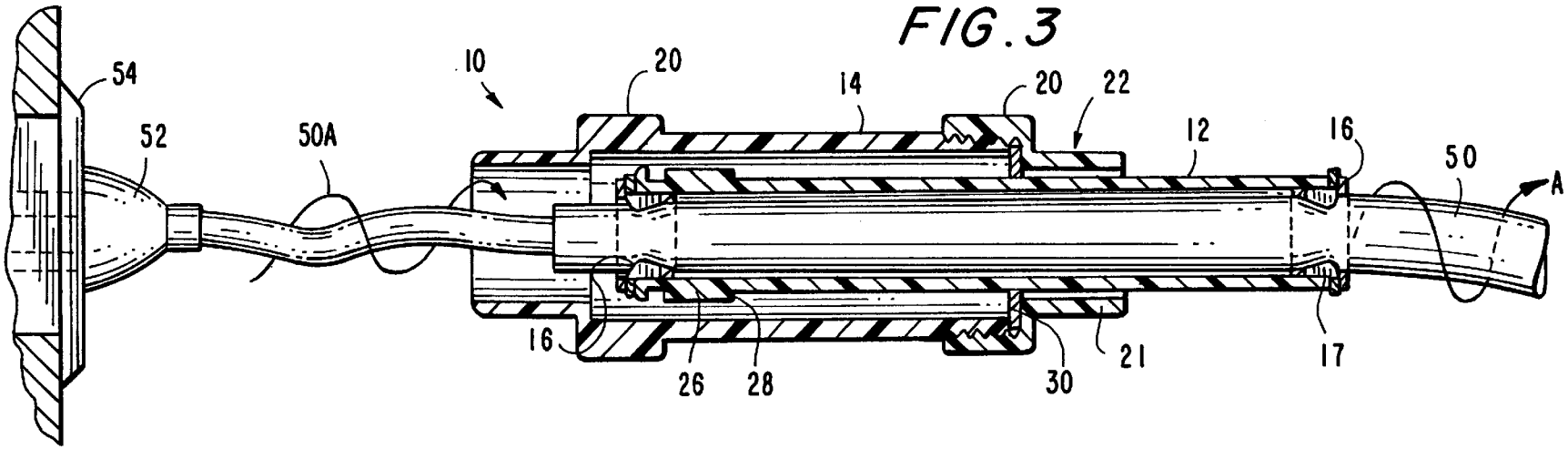
FIG. 3 is a side elevation view similar to FIG. 2 in which the apparatus of the invention is shown in section.
Figure 4:
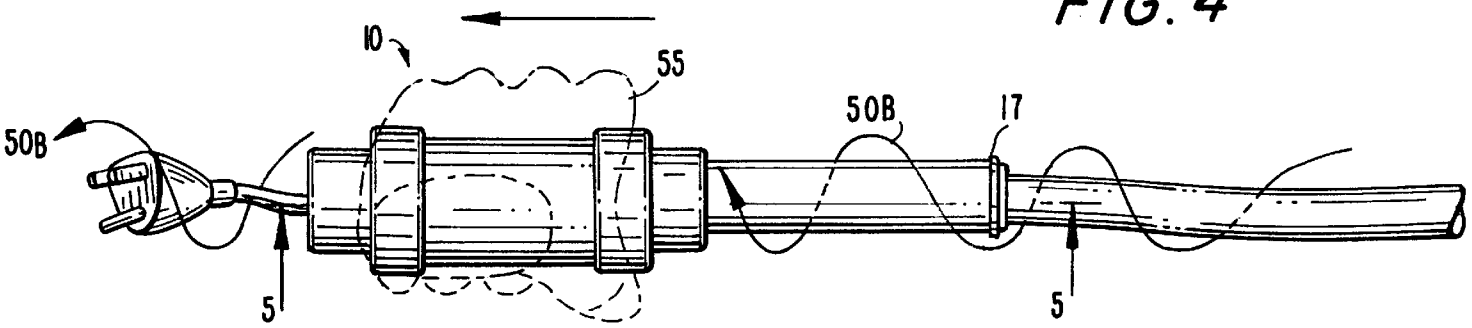
FIG. 4 is an further elevation view similar to that of FIG. 2, partly in phantom, showing the method of utilizing the apparatus of the invention to uncoil the power cable.

With further reference to FIG. 2 and the cross-sectional view of FIG. 3, it will be seen that uncoiling assembly 10 is comprised of an interior surface 12 in the form of a an annular member formed with a flange 26 at its proximal end, i.e., the end that is proximate the cable connector 52 which becomes the free end of the power cable when removed from the power supply. As used herein, the proximal end of the apparatus is to be understood as that which is closest to the free end, or to an individual who is gripping the device to apply a pulling force, the distal end necessarily being that which is closest to the section of the power cable from which the twists and coils are to be removed. In this regard, reference is made to FIG. 4 in which there is shown in phantom a hand 55 griping the device 10 and applying a longitudinal or axial force in the direction of the arrow.

With further reference to FIG. 3, the annular member 12 is formed with a flange 26 that defines a bearing surface 28 at its proximal end. Annular member 12 is formed from or coated with a plastic material exhibiting low frictional characteristics on its exterior surface and is fixed in position on power cable 50 by appropriate clamps 16. In the embodiment illustrated by FIG. 3, Heyco snap bushings are depicted. As will be understood by one of ordinary skill in the art, the cylindrical member 12 can be secured by any number of adhesive and/or other mechanical means which are well known in the art. A second surface in the form of coaxially mounted rotatable annular member 14 is positioned to surround all or a portion of annular member 12. Member 14 is formed with a pair of radially extending flanges 20 at its ends to facilitate manual gripping and prevent slipping. The exterior surface of annular member 14 can be provided with an appropriately contoured surface to facilitate the user's grip and can be provided with a scored or otherwise roughened surface, or coated or covered with a high friction material to minimize slipping. In the embodiment illustrated schematically in FIG. 3, a washer 30 is placed on member 12 and has an outside diameter that permits it to be received on the interior of member 14 and to be engaged by the interior surface of collar 21. From the embodiment illustrated by FIG. 3, it will be understood that cap 22 is threaded onto member 14 to form an integral construction. Alternatively, the entire unit can be formed integrally, as by molding or machining from an appropriate weather and chemically-resistant material, preferably a polymer that is designed to withstand weathering and swimming pool maintenance chemicals. Retaining means are also provided to maintain the outer member 14 in position around the inner member 12, such as by a radially projecting collar, flange or clip 17 located at the distal end of the device.

Figure 5:
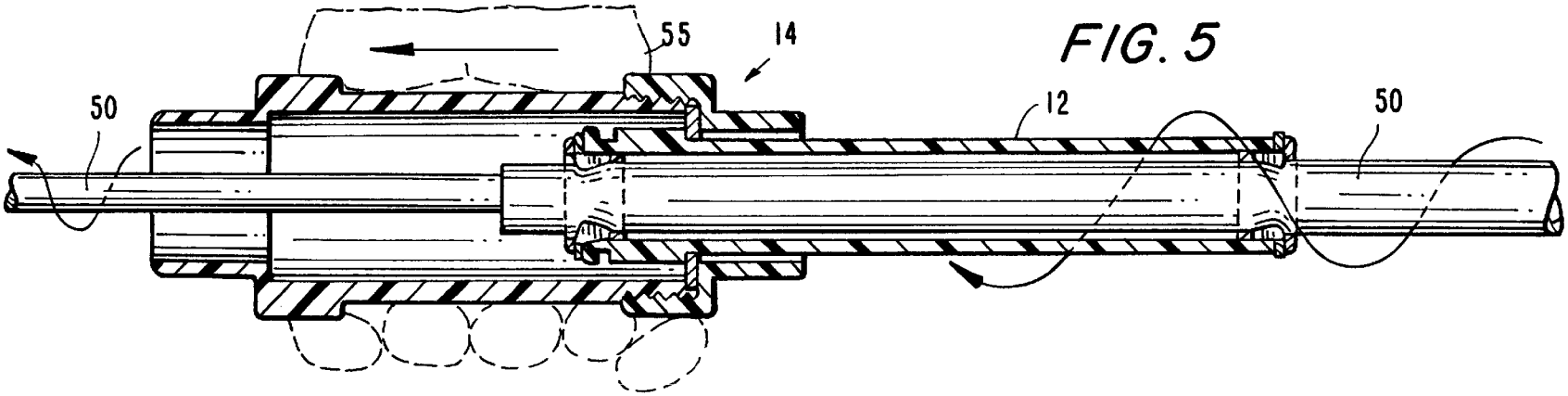
FIG. 5 is a side elevation view similar to FIG. 4, partly in section.
Figure 6:
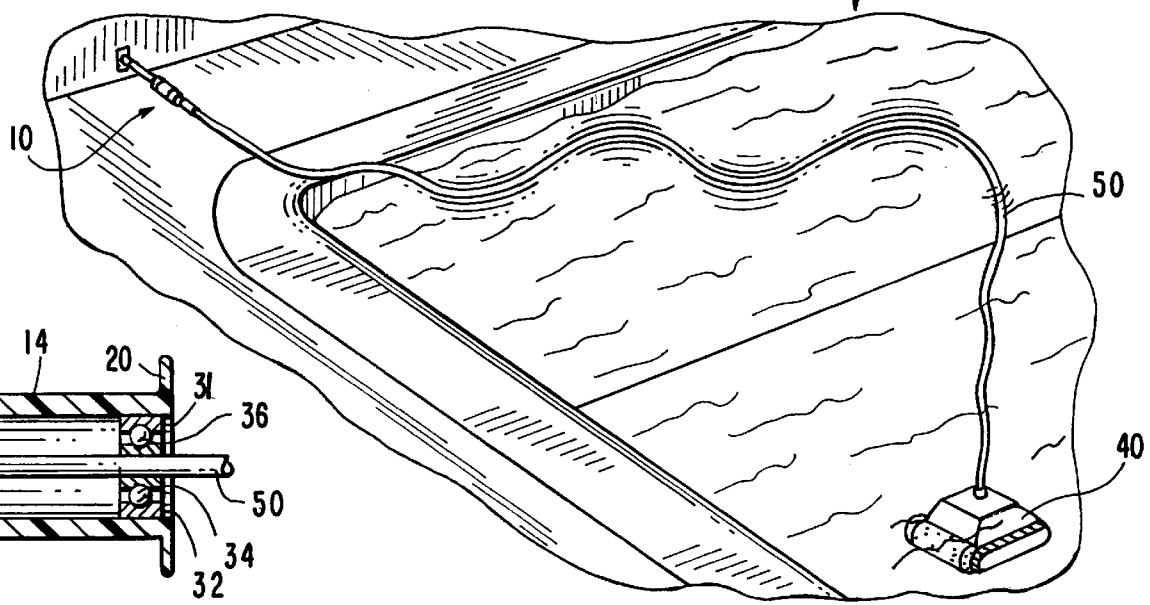
FIG. 6 is a perspective view simile to FIG. 1 showing the power cable in a relaxed, uncoiled condition following the practice of the method of the invention.

The practice of the method and functioning of the apparatus 10 will be described with reference to FIG. 5 where a longitudinal force has been applied manually by gripping the outer cylindrical member 14 and pulling away from the twisted and coiled length of the power cord. This causes a relative movement between cylindrical members 12 and 14 bringing washer 10 into contact with the bearing surface 28 of flange 26. Washer 30 is also constructed from an engineering plastic exhibiting a low coefficient of friction such as nylon, high or low density polyethylene, and copolymers, or other material that has been provided with a coating such as PTFE or FEP resins. The engagement of washer 30 with bearing surface 28 effectively creates a thrust bearing, and the continued application of a longitudinal force against the resisting force of the twisted power cable results in a translation into a rotational movement that has the effect of uncoiling and removing the twists from power cable 50. Following the practice of the method of the invention, the cable connector 52 is again inserted in power supply outlet 54 as shown in FIG. 6 and the buoyant cable 50 is restored to a relaxed, uncoiled condition which permits it to easily follow the course of the moving pool cleaner, thereby assuring that the pool cleaner will be able to complete either its pre-programmed movements or a random pattern intended to cover the entire surface of the pool to be cleaned.

Figure 7:
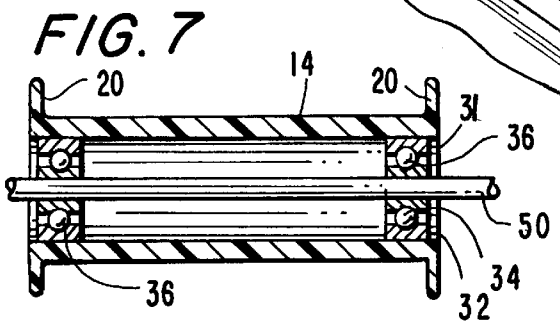
FIG. 7 is a side elevation view of another embodiment of the apparatus of the invention, shown partly in section.

With reference to FIG. 7, a further embodiment of the invention is illustrated in which the exterior surface of the power cable 50 is employed to support a pair of bearings 31 that are securely affixed to the cable, as by adhesive. Each of the bearings 31 are comprised of an outer race 32, an inner race 34 and a plurality of ball bearings 36. In this embodiment, the outer race 32 is fixed with respect to cylindrical grip member 14 and cable 50, being secured to inner race 34 is able to freely rotate axially by virtue of the movement afforded by ball bearings 36. As shown, grip 14 is also provided with radially extending flanges 20 at its opposite ends to facilitate the manual gripping and application of the longitudinal pulling force required to produce the rotational movement to untwist and uncoil power cable 50. As will be understood by one of ordinary skill in the mechanical arts, a variety of bearing constructions can be substituted for the ball bearings of FIG. 7. Equivalent constructions would include roller and needle bearings, thrust bearings, bearings having slip surfaces without internal moving parts, and the like. The bearings can be of plastic or stainless steel construction. It is also to be understood that the bearings can be secured with respect to the power cable 50 and/or the exterior annular grip member 14 by means other than adhesive, for example, by specially molded channels and the like.

Figure 8:
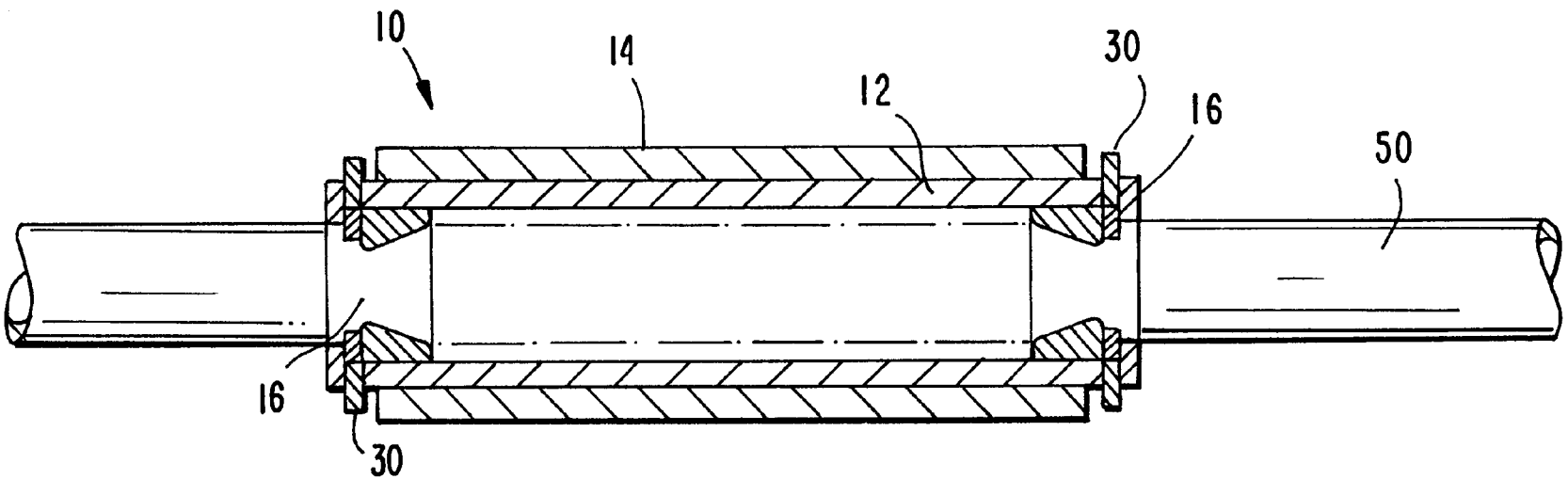
FIG. 8 is a side elevation view of yet another embodiment of the apparatus of the invention, shown partly in section.

A further embodiment of the rotating grip assembly of the invention is illustrated in FIG. 8 in which inner annular member 12 and outer annular member 14 are maintained in relative rotational engagement by a pair of washers 18 that extend radially from snap bushings 16 that engage the cable 50 and annular member 12. As will be understood from the descriptions provided above, the application of a longitudinal or axial force to outer cylindrical member 14 against one or the other of the bearing washers 18 which are fixed with respect to cable 50, will translate into a rotational force causing the cable 50 to untwist.

We claim:

1. An apparatus for removing undesired coils in a coiled swimming pool cleaner power cable extending between power supply means and a pool cleaner, said power cable having a cable connector on at least one end that can be disconnected from said power supply means or said pool cleaner, the apparatus comprising:

a) a first fixed surface extending around the power cable proximate the cable connector;

b) a second surface extending around, and rotable in relation to the first surface; and c) bearing means that are fixed with respect to the power cable and extend to contact said rotatable second surface and to retain said second surface in position with respect to the first surface, whereby an axial force applied to the second surface in the direction of the disconnected cable connector is translated into an uncoiling rotational movement by the power cable.

2. The apparatus of claim 1 where the first surface is the exterior surface of the power cable.

3. The apparatus of claim 2 where the bearing means is secured to the exterior surface of the power cable.

4. The apparatus of claim 3 where said second surface is a rotatable annular member and the bearing means comprise a pair of annular bearing members that contact the rotatable annular member in longitudinally spaced relation.

5. The apparatus of claim 4 where the bearing members are roller bearings comprising an inner race and an outer race and the inner race of each of said bearings are fixed relative to the power cable.

6. The apparatus of claim 1 where the first and second surfaces are respectively, first and second annular members constructed of low-friction material and mounted coaxially on said power cable, and said bearing means extends radially to contact the an of the second annular member proximate the cable connector.

7. The apparatus of claim 6 where the bearing means is integrally formed with the first annular member.

8. The apparatus of claim 1 which further comprises retaining means for maintaining the relative position of the first and second surfaces with respect to the power cable.

9. The apparatus of claim 1 where the bearing means is a thrust bearing having a body that surrounds and is affixed to the power cable.

10. The apparatus of claim 1 where the second surface comprises manual group means.

11. The apparatus of claim 10 where the manual grip means includes an irregular surface contour.

12. The apparatus of claim 10 where the manual grip means includes a high friction coating.

13. The apparatus of claim 10 where the manual grip means includes at least one flange extending radially outward at the end of the surface proximate the cable connector.

14. The apparatus of claim 1, where the first and second surfaces are comprised of first and second annular members co-axially mounted on said power cable.

15. The apparatus of claim 14, where at least one of the annular members is formed from two sections that are joined along a longitudinal parting line.

16. The apparatus of claim 15, where the two sections forming an annular member are joined mechanically.

17. The apparatus of claim 15, where the two sections forming an annular member are joined adhesively.

18. The apparatus of claim 1 where an offset portion of the second surface extends radially towards the power cable and terminates proximate the bearing means, whereby the offset portion contacts the bearing means when the axial force is applied to the second surface.

19. The apparatus of claim 18 where the bearing means comprises a planar surface exhibiting a low coefficient of friction.

20. A method for removing undesired coils in a coiled swimming pool cleaner power cable extending between power supply means and a pool cleaner, said power cable having a cable connector on at least one end that can be disconnected from said power supply means or said pool cleaner, the method comprising:

a. providing a bearing-mounted manual grip member;

b. securing the bearing-mounted manual grip member to the power cable proximate the cable connector and in co-axial alignment with the power cable;

c. disconnecting the cable connector from either the power supply means or the pool cleaner;

d. manually applying an axial force to the grip member in the direction of the free end of the cable connector and against the resisting force of the coiled power cable, whereby the axial force is translated into a rotational movement of the power cable in a direction that removes coils from the power cable; and e. continuing to apply the axial force to the grip member until the rotational movement of the power cable ceases.

21. The method of claim 20 where the bearing-mounted grip member is secured directly to the exterior surface of the power cable.

22. The method of claim 20 where the bearing-mounted grip member is secured to the power cable by mechanical fasteners.

23. The method of claim 20 where the bearing-mounted grip member comprises a thrust bearing.

24. The method of claim 20 where the bearing-mounted grip member comprises an annular member having a contoured gripping surface.

* * * * *